US007976442B2

(12) United States Patent
Quinn

(10) Patent No.: US 7,976,442 B2
(45) Date of Patent: Jul. 12, 2011

(54) APPARATUS FOR EXERCISING MULTIPLE BODY PARTS

(76) Inventor: Anthony Quinn, Malahide (IE)

( * ) Notice: Subject to any disclaimer, the term of this patent is extended or adjusted under 35 U.S.C. 154(b) by 0 days.

(21) Appl. No.: 12/083,826

(22) PCT Filed: Oct. 23, 2006

(86) PCT No.: PCT/IE2006/000116

§ 371 (c)(1),
(2), (4) Date: Oct. 31, 2008

(87) PCT Pub. No.: WO2007/046078

PCT Pub. Date: Apr. 26, 2007

(65) Prior Publication Data

US 2009/0098986 A1 Apr. 16, 2009

(30) Foreign Application Priority Data

Oct. 21, 2005 (IE) ..... 2005/0707

(51) Int. Cl.
*A63B 21/062* (2006.01)

(52) U.S. Cl. ..... 482/100; 482/98; 482/101

(58) Field of Classification Search ..... 482/95, 482/97–98, 100–102, 138, 116, 135, 137, 482/93, 99

See application file for complete search history.

(56) References Cited

U.S. PATENT DOCUMENTS

| | | | | | |
|---|---|---|---|---|---|
| 3,912,263 | A | * | 10/1975 | Yatso | 482/98 |
| 4,317,566 | A | | 3/1982 | Uyeda et al. | 482/98 |
| 4,354,675 | A | | 10/1982 | Barclay et al. | 482/98 |
| 4,358,108 | A | * | 11/1982 | Voris | 482/98 |
| 4,624,457 | A | | 11/1986 | Silberman et al. | 482/98 |
| 4,817,943 | A | | 4/1989 | Pipasik | 272/117 |
| 4,846,458 | A | * | 7/1989 | Potts | 482/26 |
| 4,915,377 | A | | 4/1990 | Malnke et al. | 272/118 |
| 5,217,422 | A | * | 6/1993 | Domzalski | 482/138 |
| 5,688,216 | A | * | 11/1997 | Mauriello | 482/135 |
| 6,315,702 | B1 | * | 11/2001 | Ikonomopoulos | 482/138 |
| 7,316,634 | B2 | * | 1/2008 | Webber | 482/93 |
| 2006/0160676 | A1 | | 7/2006 | Sato | 482/94 |

OTHER PUBLICATIONS

Dictionary Definition: http://dictionary.reference.com/browse/along.*

* cited by examiner

*Primary Examiner* — Allana Lewin
*Assistant Examiner* — Shila Abyaneh
(74) *Attorney, Agent, or Firm* — Jacobson Holman PLLC

(57) ABSTRACT

An exercise apparatus for exercising multiple body parts includes a frame and a front user bearer assembly which is angularly and height adjustable relative to the frame. The front bearer assembly is mounted to a guide for guiding upward and downward movement of the front bearer assembly. A compensator to ensure that the front assembly travels in a substantially vertical plane during exercise includes a number of support elements, which are pivotally mounted.

24 Claims, 13 Drawing Sheets

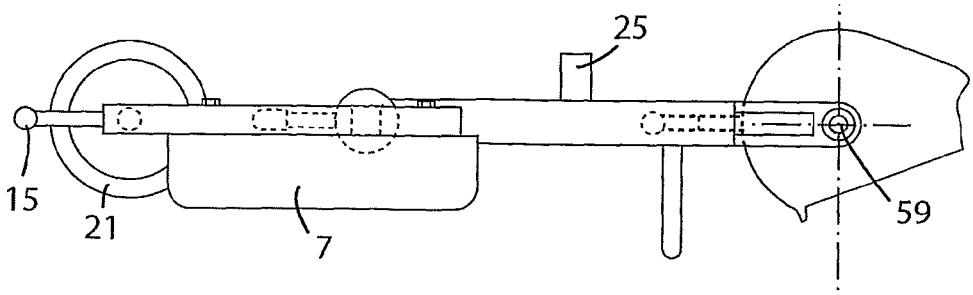
Fig. 7
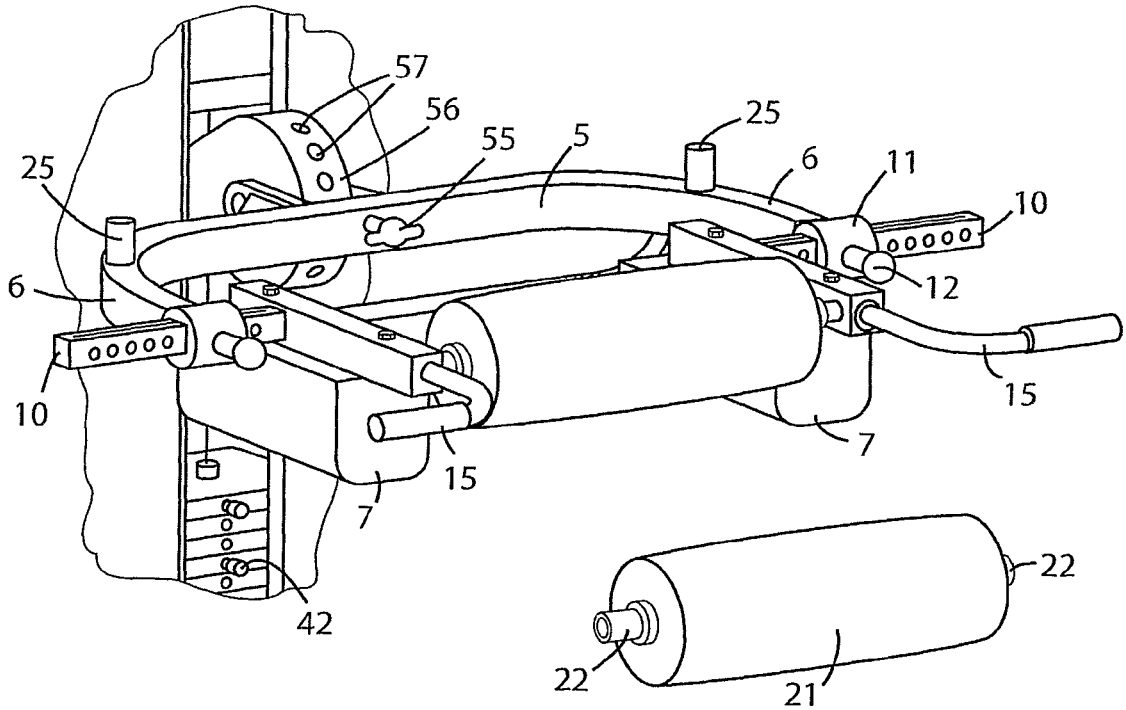
Fig. 6
Fig. 5

APPARATUS FOR EXERCISING MULTIPLE BODY PARTS

This is a national stage of PCT/IE06/000116 filed Oct. 23, 2006 and published in English.

INTRODUCTION

This invention relates to the field of resistance training apparatus, in particular apparatus for medium to heavy resistance training of the chest, back, thighs, calves, shoulder and arm muscles.

BACKGROUND OF THE INVENTION

Due to space restrictions commonly found in gyms and homes it is desirable to have a single machine which allows as many exercise functions as possible. Apparatus to date has endeavoured to combine exercise functions for lighter training in particular, taking the approach of joining several stations closely together, possibly using a common resistance device or weight stack for compactness, but has failed to provide the possibility of heavy training of chest, legs, arms, shoulders and back with a single unified piece of apparatus in a single compact station which is compact, easy to operate, and requires the exerciser to use it in positions optimal for training.

Because of the wide range of weights required and highly varying types of movement, previous machines have often failed to satisfy the needs of weight trainers. The present invention addresses this problem by means of several advances in the art.

STATEMENTS OF INVENTION

According to the invention there is provided an exercise apparatus comprising:

a frame;

a front user bearer assembly against which a user bears during exercise;

guide means to which the front user bearer assembly is mounted for guiding upward and downward movement of the front assembly relative to the frame during exercise; and compensating means to ensure that the front assembly travels in a substantially vertical plane during exercise.

In one embodiment the apparatus comprises a support system for the front assembly. The support system preferably includes the compensating means.

In one embodiment the support system comprises a number of support elements which are interlinked in such a way as to allow pivotal movement between adjacent support elements to provide the compensating means. The support system may comprise a support beam and a support post, the support beam being pivotal relative to the front assembly and the support post. Preferably the support post is pivotal relative to the frame.

In one embodiment the support system comprises a support beam to which the front assembly is mounted. Preferably the support beam is pivotally mounted to the guide means.

In one embodiment angle adjustment means for adjusting the angle of the front assembly relative to the support beam are provided. The adjustment means may comprise an arcuate member having a number of location holes and a spring-loaded pin which is engagable in a selected hole to set the angle of the front assembly relative to the support beam.

In one embodiment the front assembly is height adjustable.

In one embodiment the guide means comprises a guide block and linear elements, the guide block being slidably moveable relative to the linear elements. The front assembly may be mounted to the guide block.

In one case the guide means comprises at least two laterally spaced-apart linear elements. The linear elements may comprise vertical guide rails which are mounted to the frame. Preferably the guide block includes guide sleeves which are slidable along the guide rails. The guide sleeves preferably comprise linear bearings.

In one embodiment the exercise apparatus comprises a height selector means. The height selector means may comprise a selector rail and a connector extending between the front assembly and the selector rail, the connector being engagable with the selector rail at one of a plurality of different locations for adjusting the height of the front assembly. In one case the selector has a plurality of vertically spaced-apart location holes and the connector comprises a pin which is selectively engagable with a selector rail hole to set the height of the front assembly.

In one embodiment the apparatus comprises a positive resistance means in the form of a stack of weights and the selector rail also provides a weight selector.

In another embodiment the apparatus comprises a positive resistance means in the form of a stack of weights and the guide rails of the guide means also guide the movement of the selected weight stack.

The front assembly preferably comprises a support and user bearer elements mounted to the support. In one embodiment the support is generally U-shaped when viewed in plan and comprises a laterally extending part and a pair of side arms extending from the lateral element. The user bearer elements are preferably mounted to the side arms.

In one case the bearer elements are adjustably mounted to the side arms. A gap between the bearer elements may be width adjustable. In one case the bearer elements are selectively slidable relative to the side arms.

In one embodiment the bearer elements comprise hand grips.

According to one embodiment of the invention the user bearer elements comprise a bearer element which is demountable from the front assembly. The demountable bearer element may comprise a bar for extending between the side arms. The demountable element may comprise a squat bar.

The exercise apparatus may comprise a counterweight to compensate for the weight of the front assembly.

In another aspect the invention provides an exercise apparatus comprising:

a frame;

a front assembly having user bearers;

the front assembly being height adjustable relative to the frame; and the front assembly being angularly adjustable relative to the frame.

In a further aspect the invention provides an exercise apparatus comprising:

a frame;

a front assembly having user bearers;

a positive resistance means, and common guide means for guiding the movement of the front assembly and the positive resistance means during exercising.

In a still further aspect the invention provides an exercise apparatus comprising:

a frame;

a front assembly having user bearers;

a positive resistance means; and common adjustment means for setting the height of the front assembly and for setting the amount of the positive resistance means.

In another aspect the invention provides an exercise apparatus comprising:

a frame;

a front assembly having user bearers; and a positive resistance means, the user bearer elements comprising a pair of laterally spaced-apart arms and the gap between the user bearer elements being width adjustable.

The user bearer elements may comprise a bearer element which is demountable from the front assembly. The demountable bearer element may be mountable between the user bearer arms.

The various aspects of the invention may include the sub-features of other aspects.

In one case the exercise apparatus comprises one station in a multi-station exercise machine.

In another case the exercise apparatus comprises a stand-alone exercise machine.

The invention provides an exercise apparatus in which both vertical and angular adjustment of the front assembly over a wide range of heights is possible.

The apparatus has a multi-point pivot system which allows movement very close to true vertical movement as opposed to the arcuate movement commonly found in prior art.

In the invention a common set of guide rails are used for both the weight stack and the front assembly.

In addition, the invention provides the use of a common selector rail for the weight stack and the height adjustment of the front assembly.

The apparatus of the invention also provides adjustable-width forward projecting bars at the front of the front assembly. Various inserts may be attached to the forward projecting bars to link the two to facilitate the performance of certain leg, calf and arm exercises.

BRIEF DESCRIPTION OF THE DRAWINGS

The invention will be more clearly understood from the following description therefore given by way of example only in which:

FIG. 5 is a perspective view of a removable bearer unit;

FIG. 6 is a perspective view of the front assembly showing the removable user bearer element in position;

FIG. 7 is a side elevational view of the assembly of FIG. 6;

DETAILED DESCRIPTION

Figure 1:
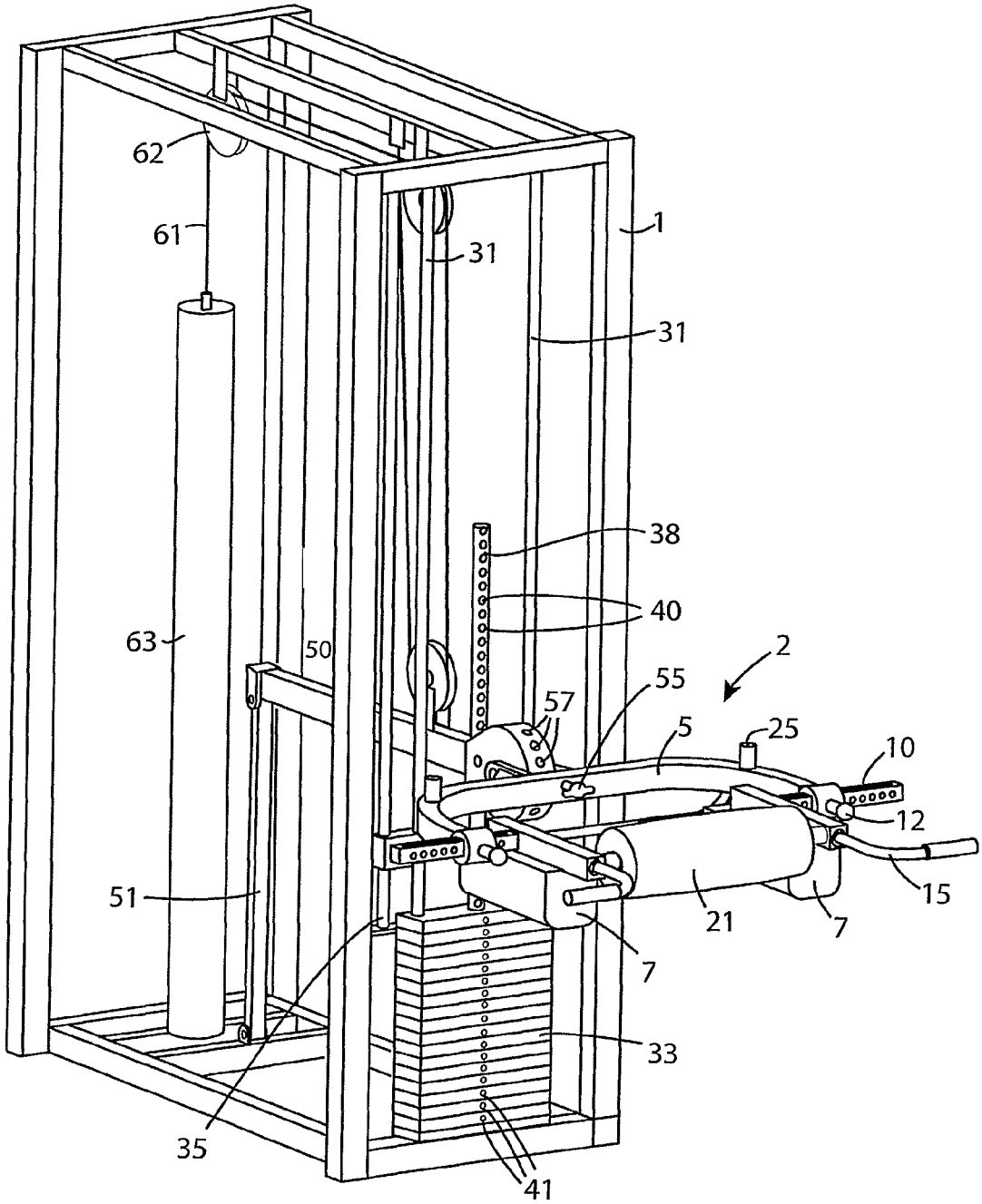
FIG. 1 is a perspective view of an exercise apparatus according to the invention.
Figure 2:
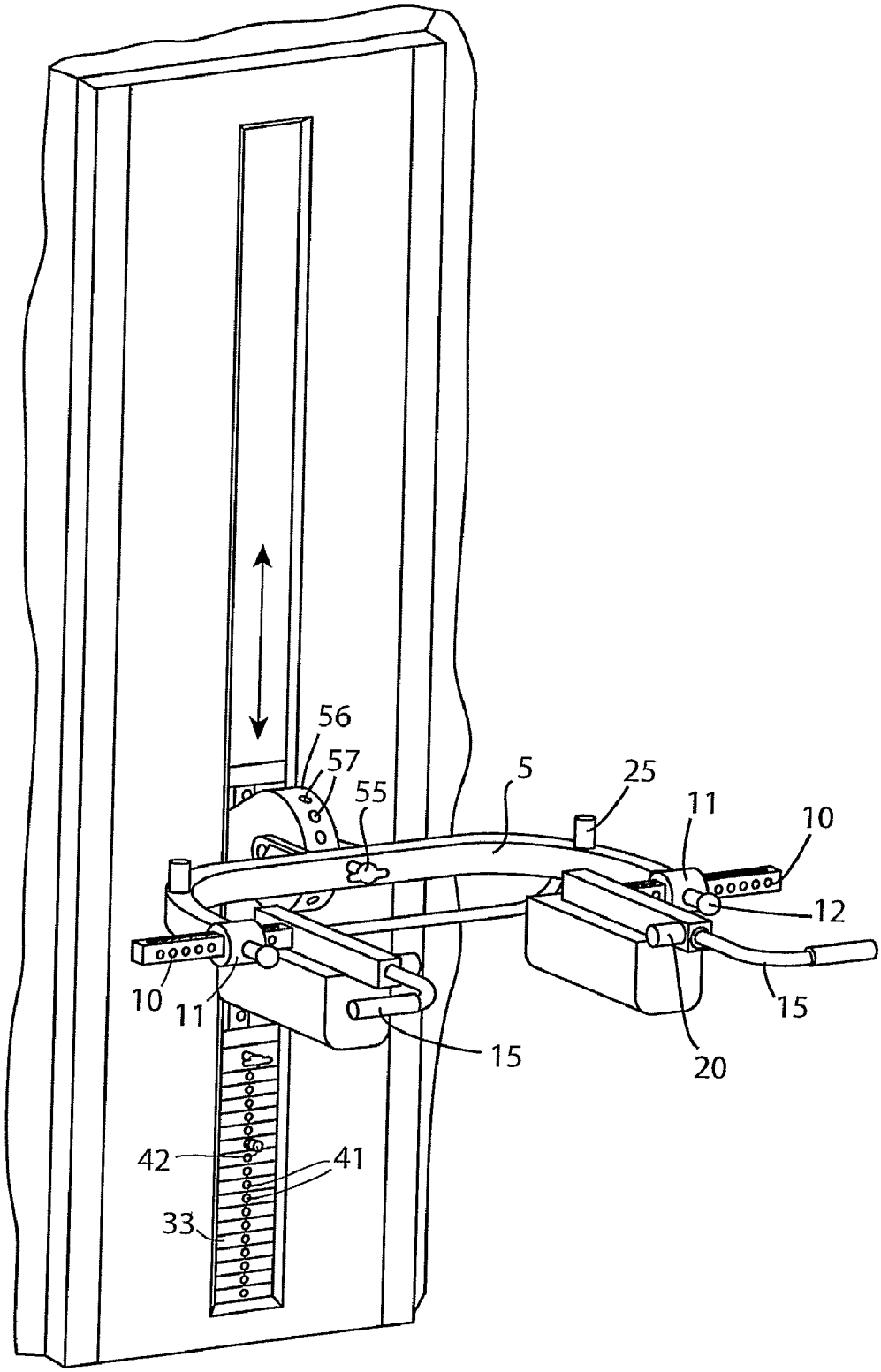
FIG. 2 is a perspective view of a front of the apparatus of FIG. 1.
Figure 4:
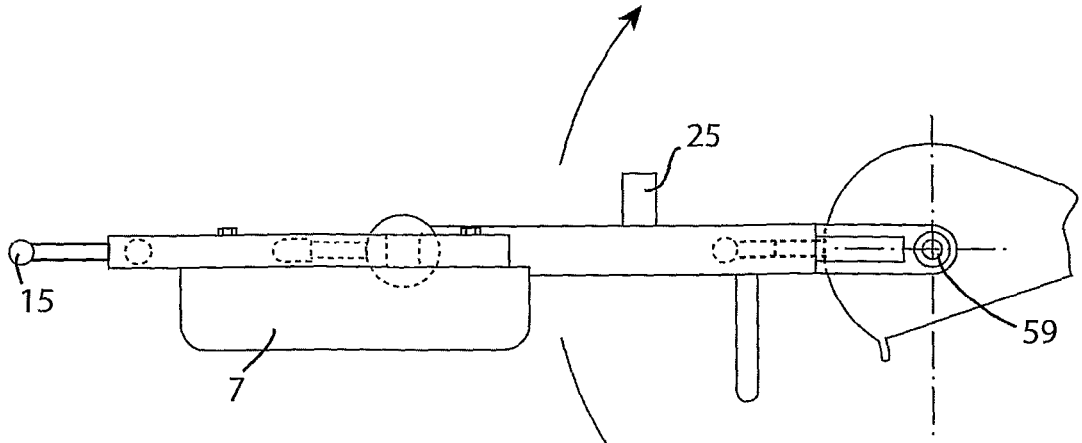
FIG. 4 is a side elevational view of the assembly of FIG. 3.

The front assembly can be set at various angles; to allow a user to bear weight on his shoulders in at least two different ways; to accommodate variations in shoulder width; to allow various pressing movements at different angles; to allow rowing or deadlifting movements; to allow certain calf exercises and arm exercises, and to allow leg press movements.

Referring to the drawings there is illustrated an exercise apparatus according to the invention. The apparatus comprises a frame 1 and a front user bearer assembly 2, which is angularly adjustable and also height adjustable relative to the frame 1. The bearer assembly 2 comprises a support 3 and user bearer elements 4 mounted to the support 3. The support 3 is of generally U-shape when viewed in plan and comprises a laterally extending part 5 and a pair of side arms 6 extending forwardly from the lateral part 5. The user bearer elements 4 are mounted to the arms 6. The bearer elements 4 may have pads 7 which may, for example, bear on a user's shoulders for performing leg exercises.

Figure 3:
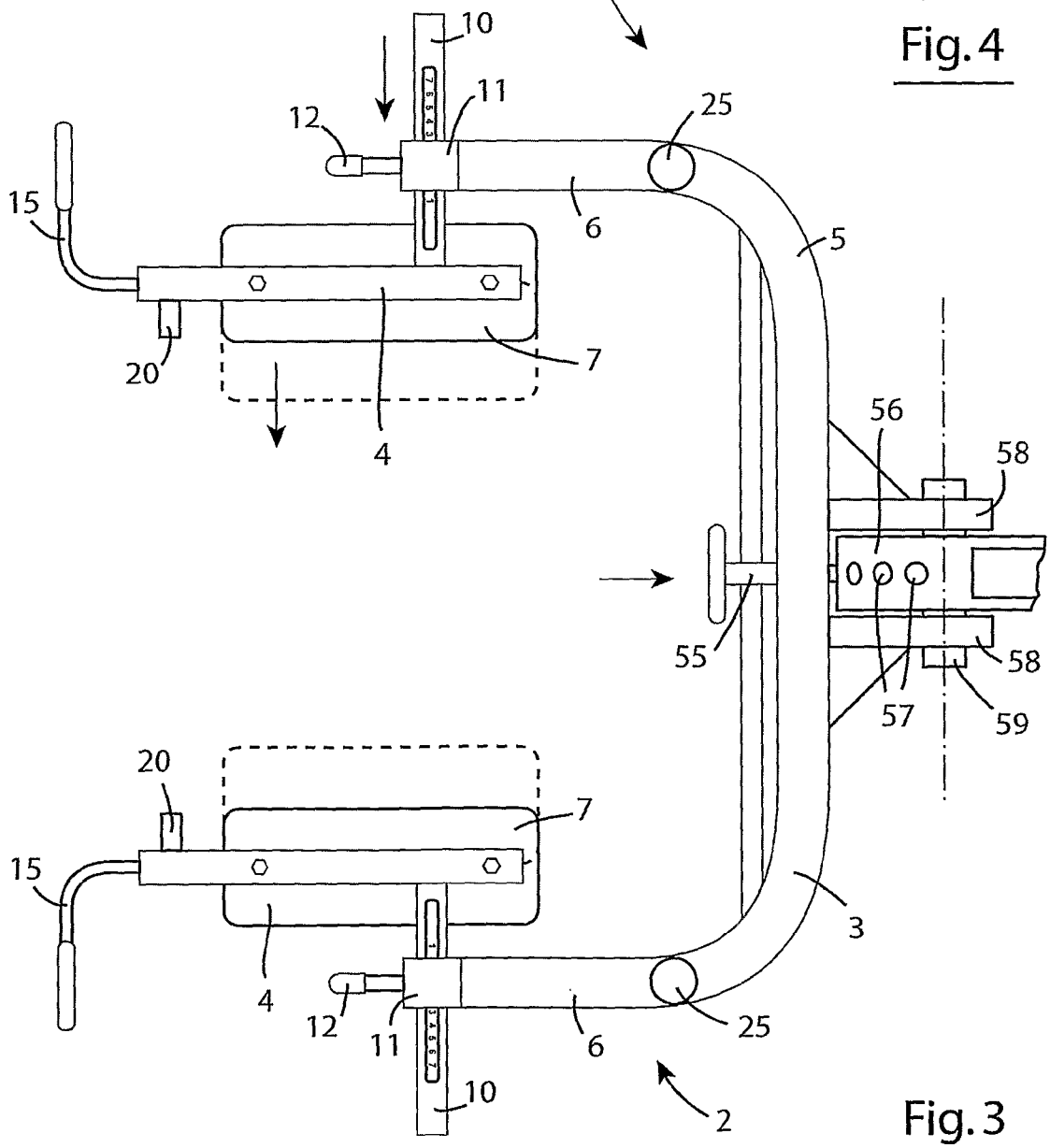
FIG. 3 is a plan view of a front assembly of the apparatus.
Figure 8:
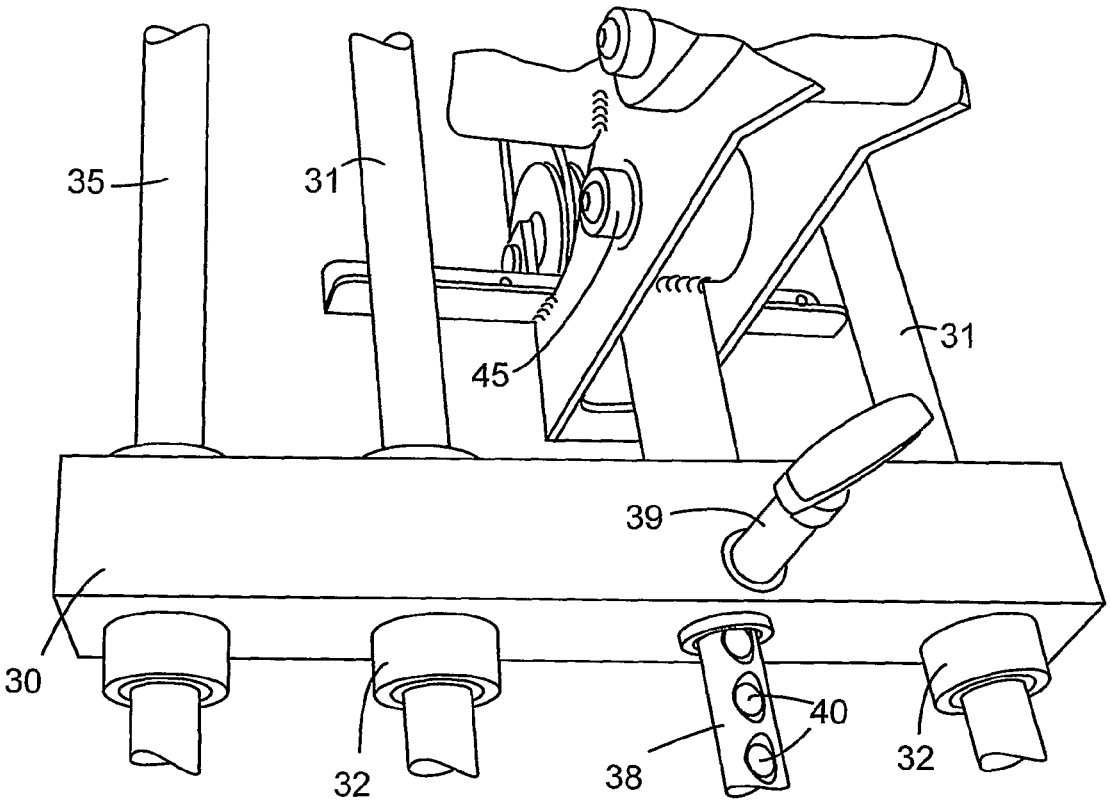
FIG. 8 is a perspective view of a guide part of the exercise apparatus.
Figure 9:
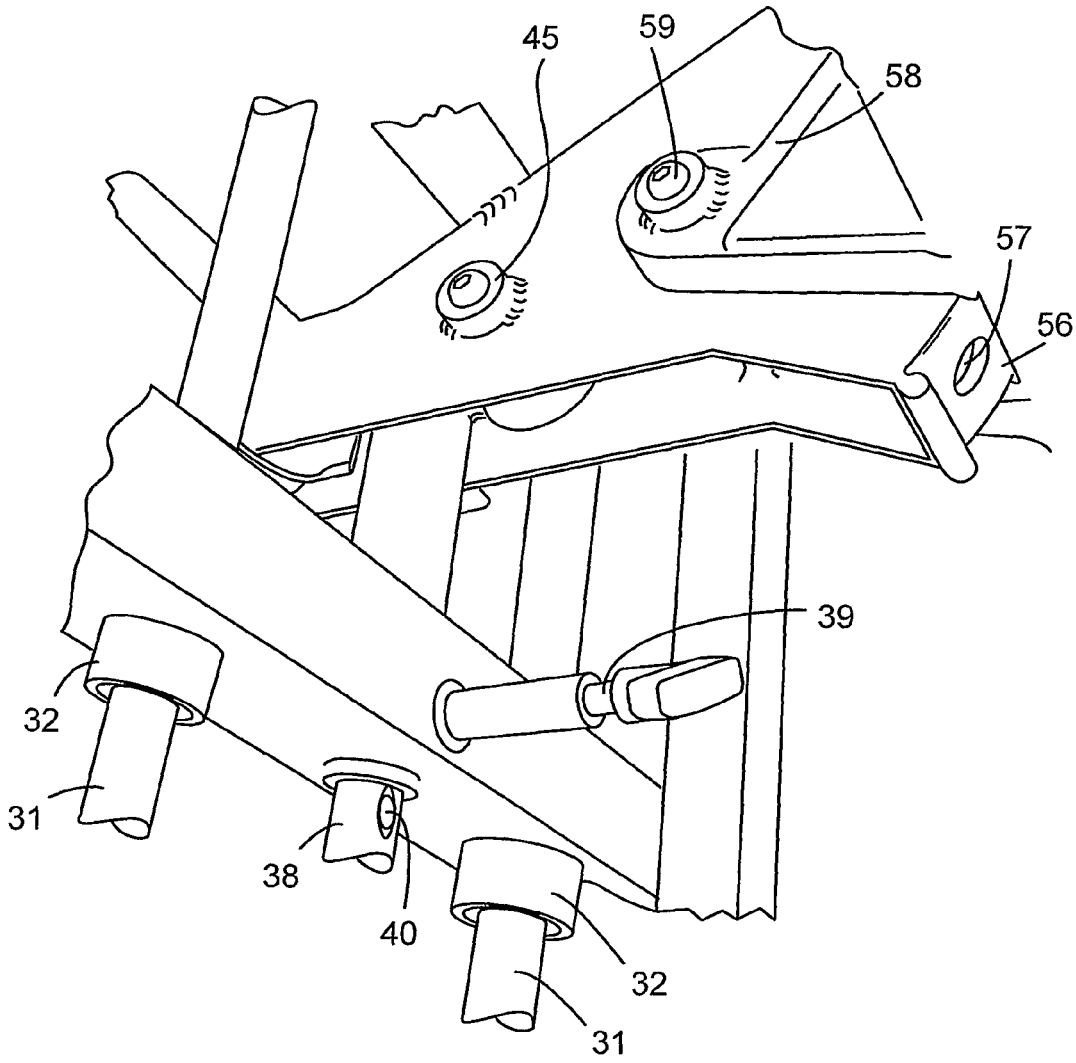
FIG. 9 is another view of the guide part of FIG. 8.
Figure 10:
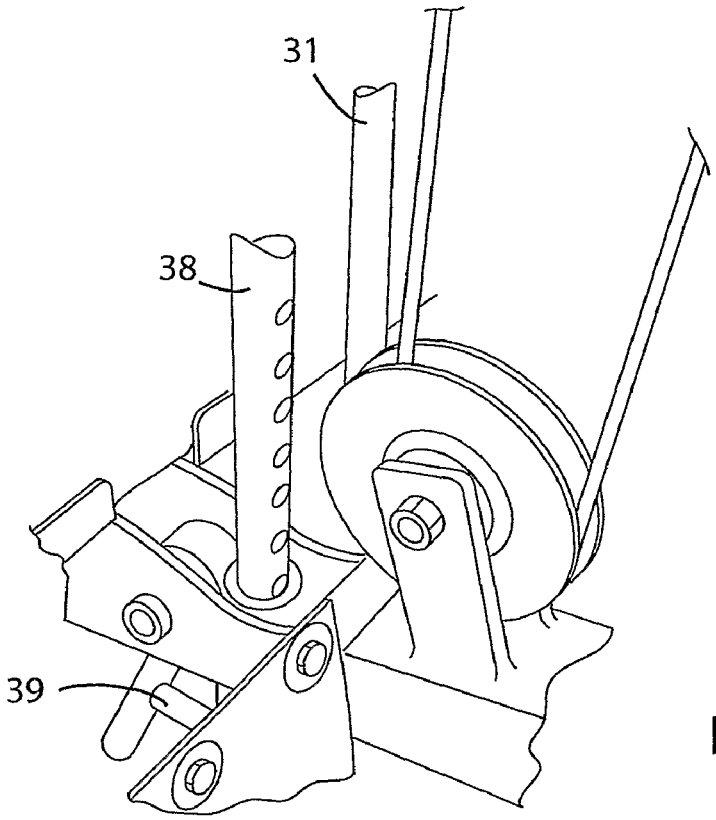
FIG. 10 is a perspective view of another part of the exercise apparatus.
Figure 11:
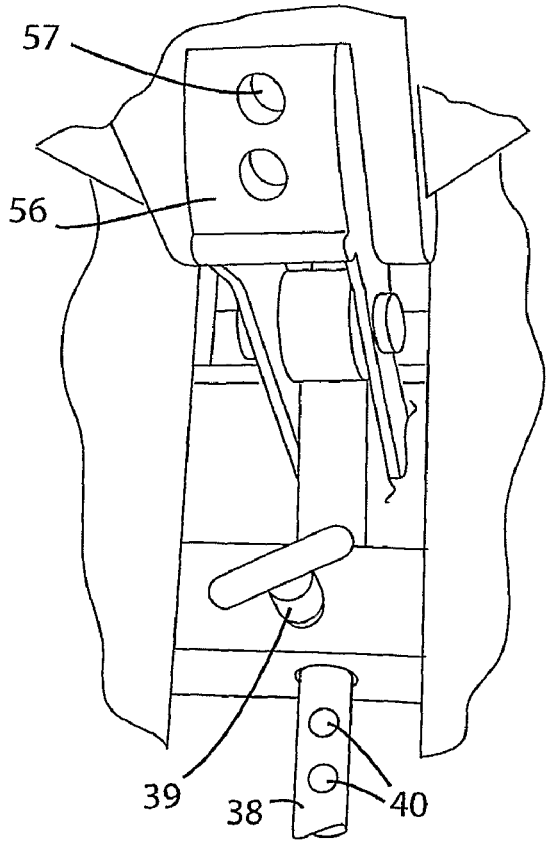
FIG. 11 is perspective view of a further part of the exercise apparatus.

The bearer elements 4 in this case are laterally adjustable as illustrated particularly in FIG. 3. Each bearer element has a right angle extension 10 of box section which is slidable in a corresponding guide 11 on the side arm 6. The extension 10 has a plurality of spaced-apart holes which are engagable by a spring loaded pin 12 to set the desired lateral position of the user bearer elements 4. Further extensions 15 on the bearer elements 4 also provide hand grips. Lugs 20 are also provided on the bearer elements 4 for mounting a further bearer element 21 (FIGS. 6 and 7) to the assembly. In one case the additional bearer element 21 may be generally cylindrical and the lugs 20 are engagable in receivers 22 of the additional bearer 21, on movement of the side bearer elements 4. The support 3 also has projections 25 to which other attachments can be mounted. One such additional attachment may be additional weights.

Each end of the support 3 provides a mechanism to support a forward user bearer element 4 suitably padded below to allow the user to take resistance on his shoulders for performing leg exercises. This mechanism allows horizontal movement of each user bearer element 4 to accommodate various shoulder widths. In this mechanism, each user bearer element 4 is provided with a right angle extension 10 at an angle of ninety degrees made of solid square section steel which can move in a square section guide 11 attached to the end of the support 3. Holes are drilled in the right angle extension 10 and the position of the unit in the guide 11 is selected by using a pin 12 which is attached to the square section guide 11 by means of a bush and spring-loaded mechanism.

Figure 16:
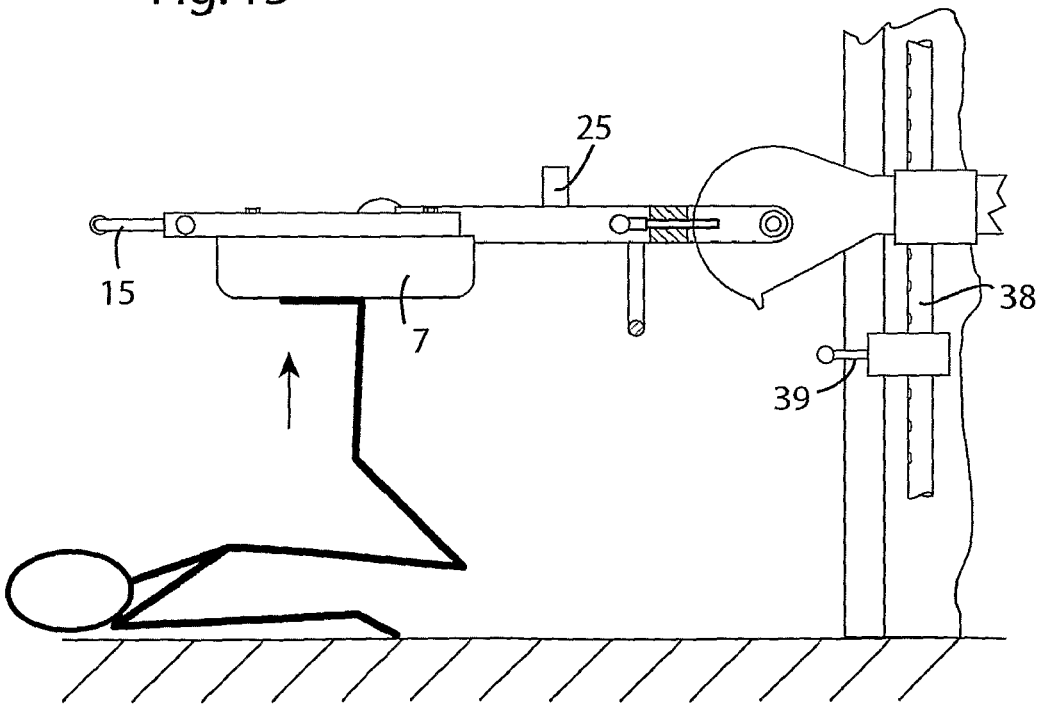
Figure 17:
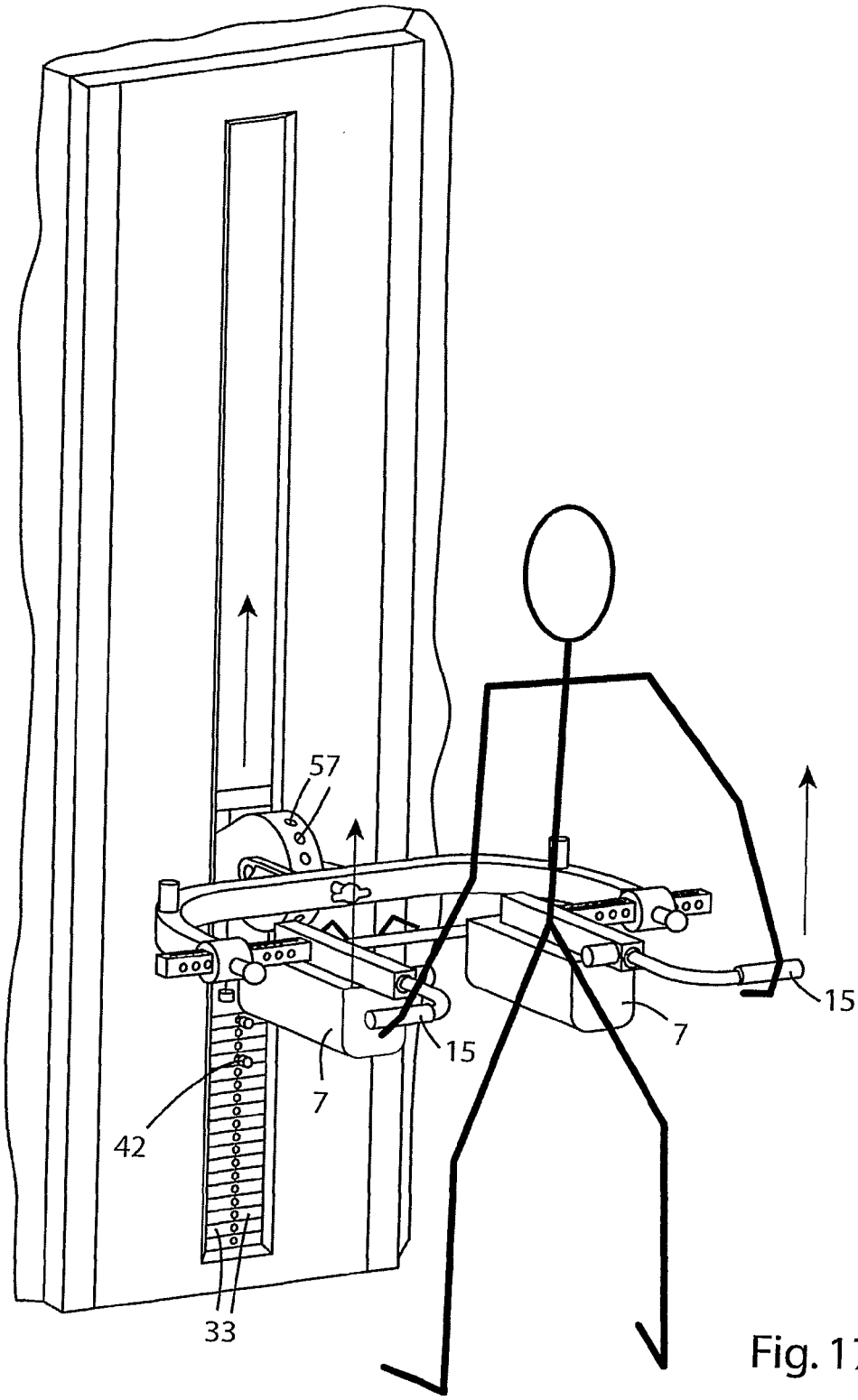
Figure 18:
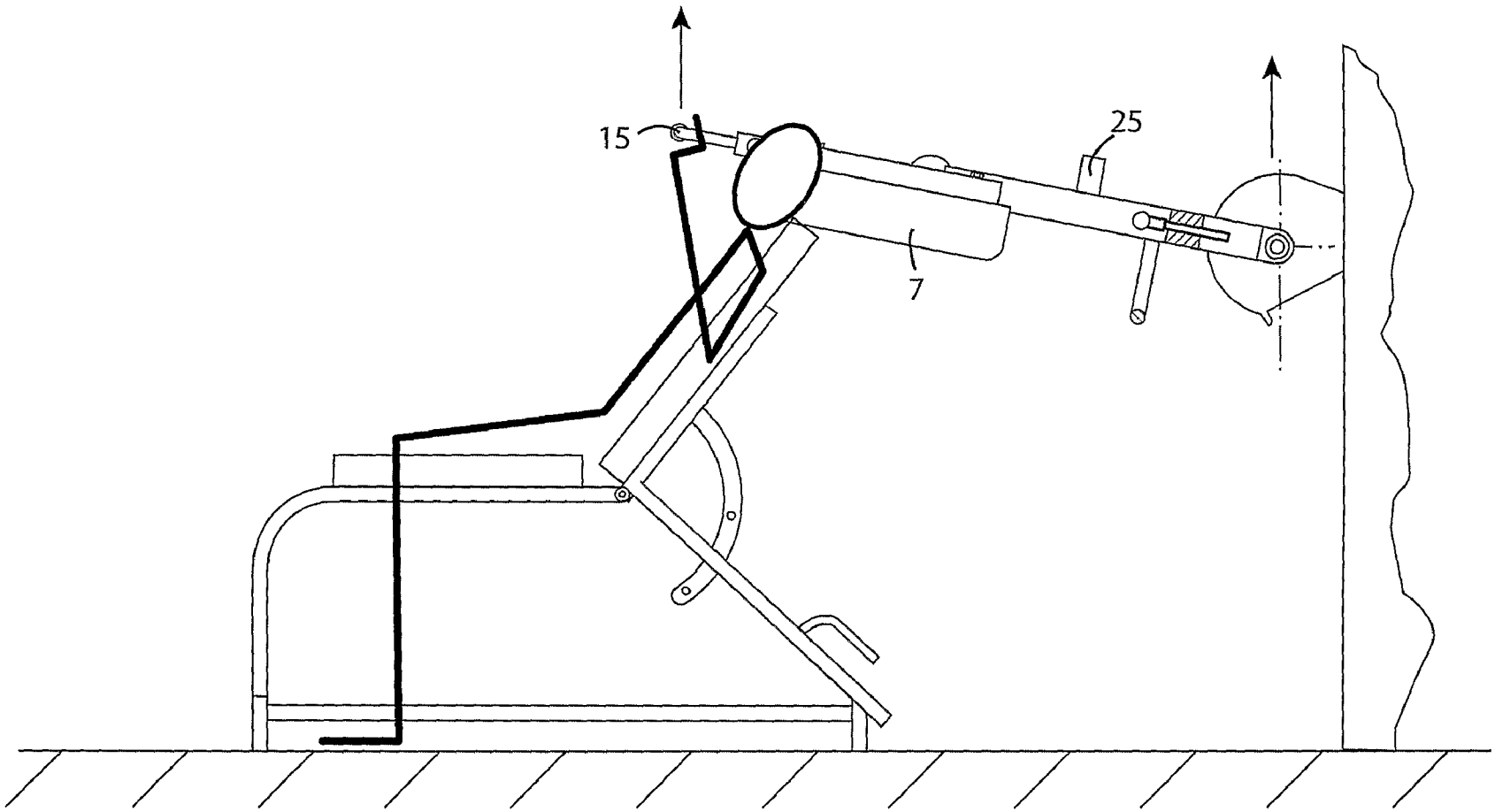

In addition, each of the forward projecting bars has handles 15 allowing the user to perform various pressing movements for instance bench press, front press, incline press, where necessary in conjunction with the bench. Furthermore, the handles 15 may be used for rowing or deadlifting movements also, and may form supports for the feet for leg press type movements. Each of the handles is bent at 90 degrees to provide an anterior and a lateral grip. The various movements may be varied according to the chosen horizontal distance between the forward projecting bars and the angle and height of the front assembly. Additionally a mechanism is provided whereby a bar 21 may be inserted between the side arms 6. Such a bar 21 may be padded allowing for performance of traditional squats, or straight or cambered to allow for the performance of narrow-grip bench press, an exercise for the triceps. All these movements may be performed with the assistance of a suitable gymnasium bench with raising back, or in the case of some, while standing, kneeling or lying on one's back. Some examples of the various exercises which can be performed are illustrated in FIGS. 16 to 18. The apparatus can also be used to perform a bench press. In this configuration a user lies flat on a flat bench with his shoulders below the hand grips 15 of the front assembly. The front assembly extends substantially horizontally and a user pushes up his arms to raise and then lower the front assembly.

The front bearer assembly 2 is mounted to a guide means for guiding upward and downward movement of the front assembly 2 relative to the frame 1 during exercise. The guide means comprises linear elements in the frame 1 and a guide block 30 which is slidably movable relative to the linear elements. The linear elements comprise two laterally spaced-apart vertical guide rails 31 which are mounted to the frame 1. The guide block 30 has guide sleeves 32 which are slidable along the guide rails 31. The guide sleeves 32 have linear bearings for ease of linear movement of the guide block 30 along the rails 31. The rails 31 also extend through a conventional weight stack 33 which provides an adjustable positive resistance means which a user may adjust (by selecting the number of weights) to make it easier or more difficult to lift the front bearer assembly 2. Thus the two rails 31 act as guides for both the guide block 30 and also the weight stack 33. There is also an additional rail 35 to one side which is attached to the frame but does not extend through the weight stack. This acts as a further guide for the guide block 30 as it is raised and lowered by the user exercising using the front assembly 2.

The apparatus also has a height selector means which in this case comprises a selector rail 38 and a connector in the form of a pin 39 which is selectively engagable with one of a plurality of vertically spaced-apart location holes 40 in the selector rail 38. The desired number of weights from the weight stack are also attached to the selector rail 38 by engaging a weight stack selector pin 42 into one of the weight stack holes 41. The selector rail 38 is not fixed to the frame and typically terminates at the low end of the weight stack. The selector rail 38, once the pin 39 is engaged, is locked to the guide block 30 which carries the front assembly so that the selector rail 38 travels with the guide block 30 as it moves along the rails 31, 35 in response to upward and downward movement of the front assembly 2 during exercise.

The guide block 30 is attached to the front assembly 2 by a pivot 45.

In the preferred embodiment, the vertical guide system comprises a pair of vertical guide bars 31 fixed above and below to the frame. The height selection mechanism consists of a central selector bar 38 with holes 40 set at centres appropriate to the height of each weight plate 33. The guide bars 31 pass through each of the weight plates 33 and also through the guide tubes on the guide unit which is in turn attached by a pivot to the front assembly. Likewise the central selector bar 38 passes through the weight plates 33 and also through a selector mechanism on the front assembly, the bar 38 being fixed below to the uppermost plate of the weights stack and being unattached above. The selector bar 38 thus provides a direct link between the front assembly and the weight stack. A removable pin is used to select the weight desired and a non-removable spring-loaded pin 55 passes through a bush in the central and distal portion of the front assembly to engage with the holes in the selector bar 38 allowing a set height to be selected.

The use of the same guide bars and selector bar for both the weight stack and the front assembly guide unit are unique features.

A support system for the front assembly comprises a number of support elements which are interlinked in such a way as to allow pivoted movement between adjacent support elements to provide a compensating means to ensure that the front assembly travels in a substantially vertical plane during exercise. Such a means is important in ensuring that the user does not have to adjust during performance of an exercise and thereby allows all energy and attention to be focussed in the muscle exercise. Further, such a means ensures that forces are not applied to the various guide rails and frame which could dislodge or damage the unit.

Figure 12:
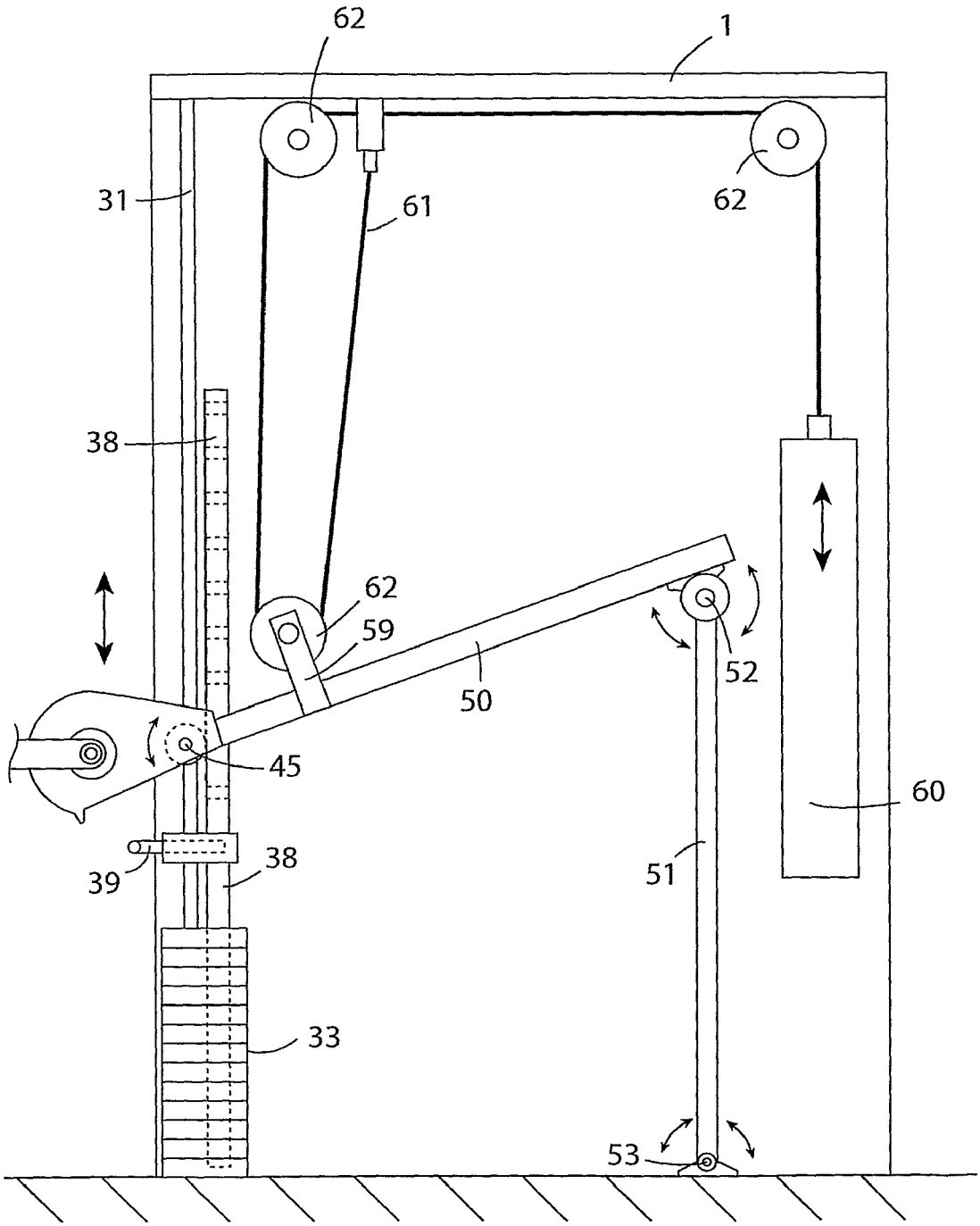
FIG. 12 is a side view of the exercise apparatus.
Figure 13:
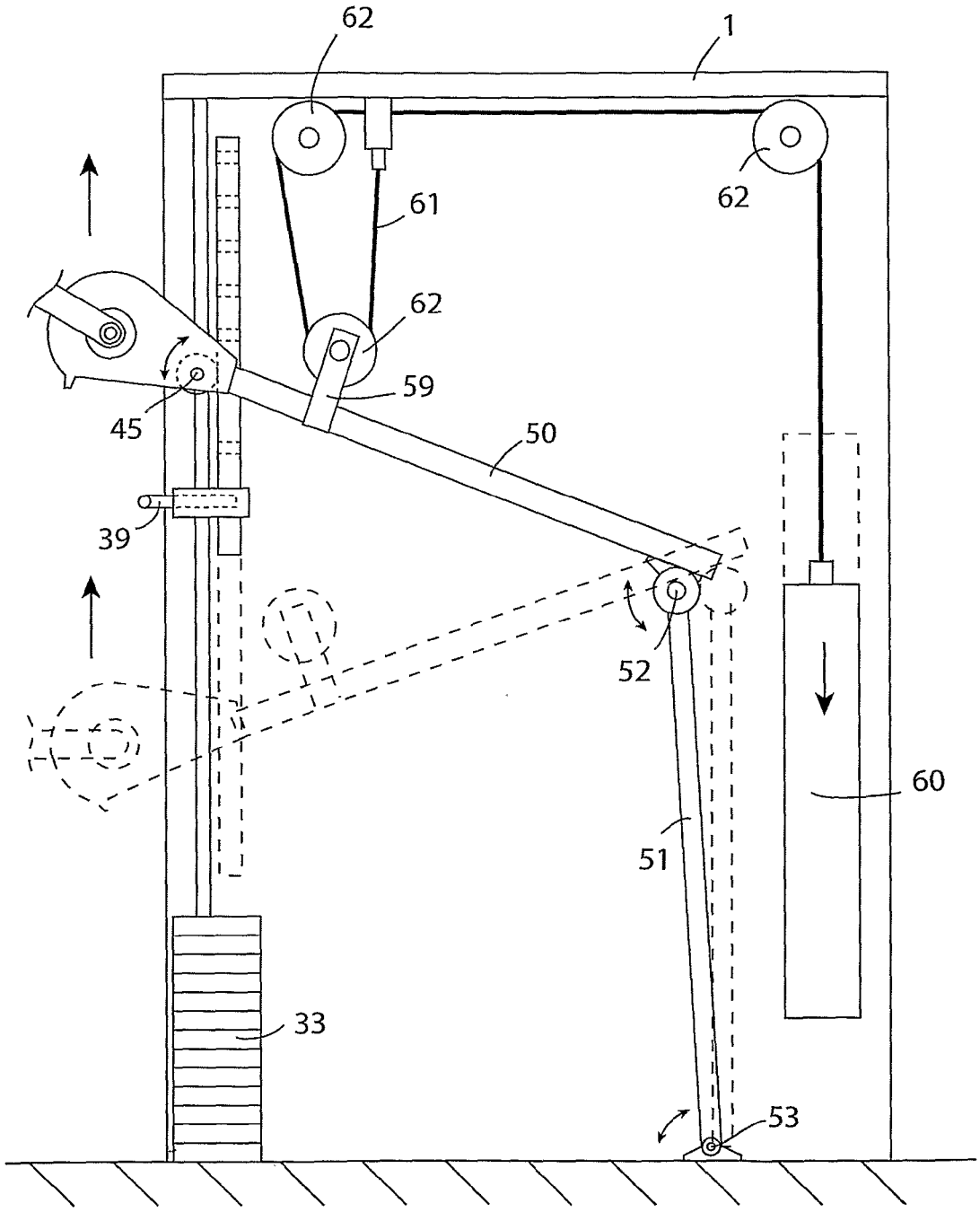
FIG. 13 is another side view of the exercise apparatus showing different configurations of use.

Referring in particular to FIGS. 12 and 13 the support system comprises a support beam 50 and a support post 51. The support beam is attached by the pivot 45 to the front bearer assembly 2 at the front end and is pivotally connected by a pivot 52 at the rear end to the support post 51. At the lower end the support post 51 is pivotally mounted at 53 to a fixture such as the frame 1. As the guide block 30 is raised and lowered the support elements can move relative to one another as illustrated particularly in FIG. 13 so that bending stresses are not applied to the guide rails. In other words, the guide block is allowed to move in a vertical plane. This multi-point pivot mechanism allows a pure vertical movement on the part of the front assembly.

The prior art typically provided a pair of forward projecting bars adapted to squatting or calf raise movements attached to a beam which pivoted around a fixed point, causing a pronounced arcuate effect, and entailing various compensatory systems.

In the invention, the beam holding the enhanced front assembly is attached firstly at its front or anterior end by a pivot to a guide unit which runs on the two vertical guide bars which in the preferred embodiment also guide the weights stack. The guide unit is provided with two sleeves each containing two linear bearings allowing it to move freely on the guide bars.

The beam holding the enhanced front assembly is attached secondly at its back or distal end to vertical post 51 by a pivot 52.

The vertical post is in turn attached to the frame by a pivot allowing anterior-posterior movement to occur. Thus the element of anterior-posterior horizontal movement of the distal end of the beam which occurs when the front end of the beam is moved up or down on fixed rails is accommodated.

Figure 14:
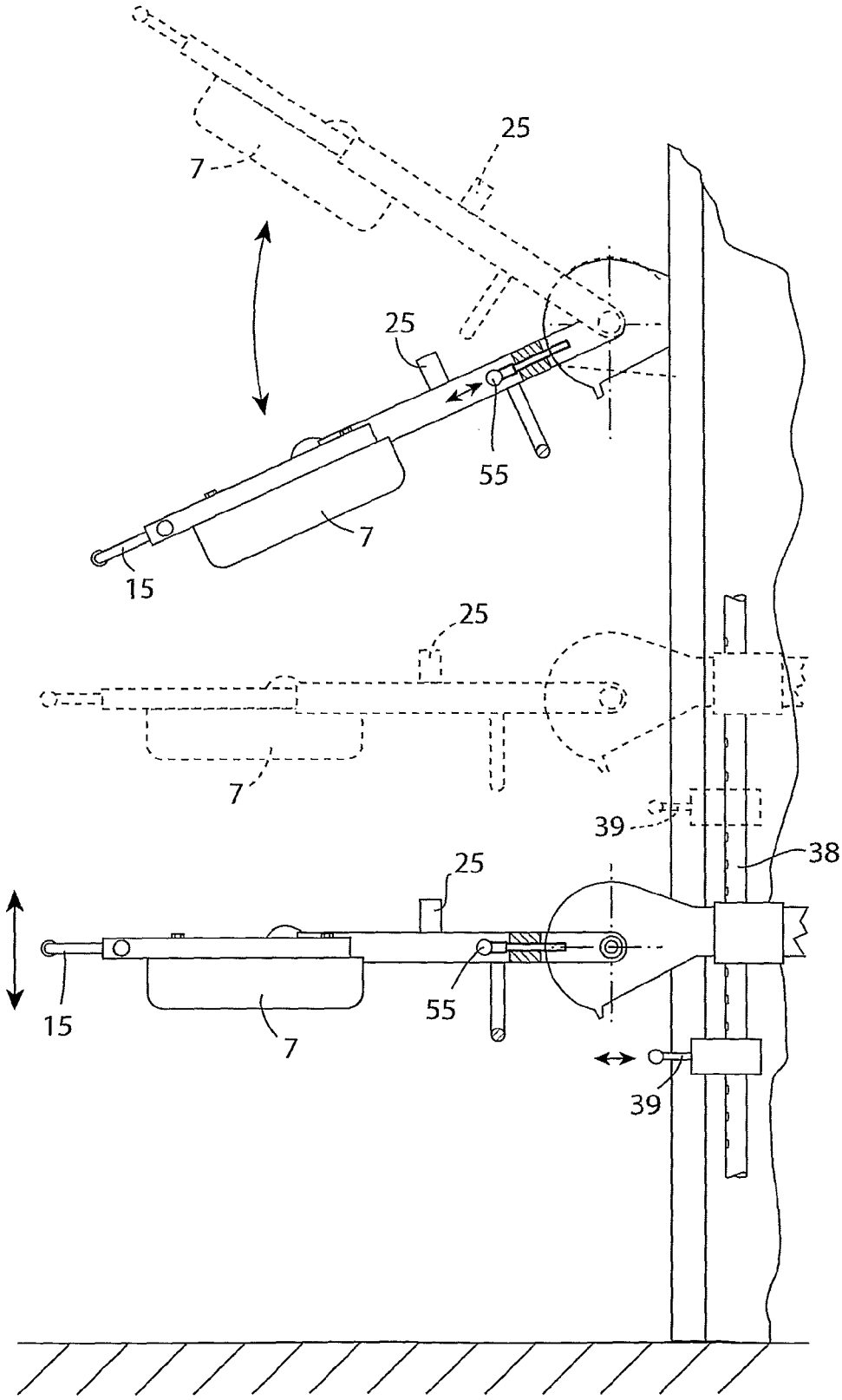
FIG. 14 is a side view of the front assembly of the apparatus showing different configurations of use.
Figure 15:
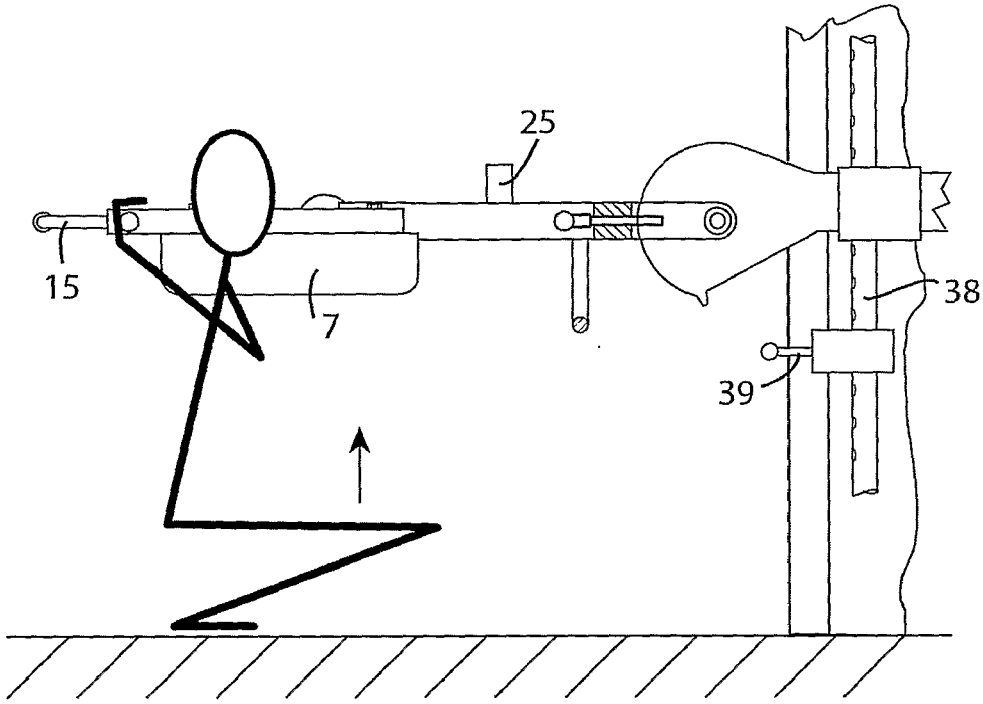
FIGS. 15 to 18 are diagrams illustrating various exercises being performed using the exercise apparatus of the invention.

Referring now particularly to FIGS. 3 and 14, the angular adjustment of the front bearer assembly is illustrated in more detail. A spring loaded selector pin 55 extends between the front assembly 2 and an arcuate selector element 56 which has a plurality of pin-receiving holes 57 which are circumferentially spaced-apart around the selector element 56. Depending on the user and/or the exercise to be performed, the angular position of the front assembly 2 relative to the guide block can be set. Angular movement of the front assembly relative to the arcuate selector element 56 is accommodated by a pair of extension plates 58 mounted to a pivot 59.

The front assembly consists of a U-shaped beam with its ends projecting forward. It provides for the placing of extra weight as needed by having two lugs suitable for weight plates.

It is attached to the vertical guide system by means of a pivot. It has a mechanism close to its attachment to the vertical guide system allowing it to be set at various angles. This consists of a hollow unit in the shape of an arc of a circle placed in front of the pivot point so that the edge of the arc is presented to the U-beam. The hollow unit is wide enough to accommodate several holes, and a mechanism on the U-beam consisting of a spring-loaded pin which is attached by means of a bush.

A counterweight 60 is attached at connection 59 to the upper surface of the support beam 50 which supports the front assembly via a cable 61 and pulleys 62. It runs in a guide tube 63. This counterweight compensates for the weight of the front assembly 2.

The invention is not limited to the embodiments hereinbefore described which may be varied in construction and detail.

The invention claimed is:

1. An exercise apparatus comprising:

a frame, the frame including upright guide rails extending in a vertical plane;

a front user bearer assembly against which a user bears during exercise for movement up and down of the front user bearer assembly along the upright guide rails;

a stack of weights guided on the upright guide rails in the vertical plane;

a guide block being directly mounted to and being slidable on the guide rails in the vertical plane for guiding upward and downward movement of the user bearer assembly relative to the frame;

a support system for the front user bearer assembly, the support system including:

a support beam and a support post;

a first end of the support beam being pivotally mounted to the front user bearer assembly;

a second end of the support beam being pivotally mounted to a first end of the support post; and a second end of the support post being pivotally mounted to the frame, the support beam and the support post being movable with the front user bearer assembly.

2. The exercise apparatus as claimed in claim 1, wherein the front user bearer assembly includes a support and user bearer elements mounted to the support.

3. The exercise apparatus as claimed in claim 2, wherein the support is generally U-shaped when viewed in plan and includes a laterally extending part and a pair of side arms extending from the lateral extending part.

4. The exercise apparatus as claimed in claim 3, wherein the user bearer elements are mounted to the side arms.

5. The exercise apparatus as claimed in claim 4, wherein the user bearer elements are adjustably mounted to the side arms.

6. The exercise apparatus as claimed in claim 5, wherein a gap between the bearer elements is width adjustable.

7. The exercise apparatus as claimed in claim 6, wherein the bearer elements are selectively slidable relative to the side arms.

8. The exercise apparatus as claimed in claim 2, wherein the user bearer elements include a bearer element which is demountable from the front user bearer assembly.

9. The exercise apparatus as claimed in claim 8, wherein the demountable bearer element includes a bar for extending between the side arms.

10. The exercise apparatus as claimed in claim 8, wherein the demountable element includes a squat bar.

11. The exercise apparatus as claimed in claim 2, wherein the bearer elements include hand grips.

12. The exercise apparatus as claimed in claim 1, wherein the upright guide rails include at least two laterally spaced-apart linear elements.

13. The exercise apparatus as claimed in claim 12, wherein the linear elements are mounted to the frame.

14. The exercise apparatus as claimed in claim 13, wherein the guide block includes guide sleeves which are slidable along the upright guide rails.

15. The exercise apparatus as claimed in claim 14, wherein the guide sleeves include linear bearings.

16. The exercise apparatus as claimed in claim 1, further comprising a height selector device.

17. The exercise apparatus as claimed in claim 16, wherein the height selector device includes a selector rail and a connector extending between the front user bearer assembly and the selector rail, the connector is engagable with the selector rail at one of a plurality of different locations for adjusting a height of the front user bearer assembly.

18. The exercise apparatus as claimed in claim 17, wherein the height selector device has a plurality of vertically spaced-apart location holes and the connector includes a pin which is selectively engagable with a selector rail hole to set the height of the front user bearer assembly.

19. The exercise apparatus as claimed in claim 17, further comprising positive resistance elements in a form of a stack of weights and the selector rail also provides a weight selector.

20. The exercise apparatus as claimed in claim 1, further comprising an angle adjustment for adjusting an angle of the front user bearer assembly relative to the support beam.

21. The exercise apparatus as claimed in claim 20, wherein the angle adjustment includes an arcuate member having a number of location holes and a spring-loaded pin which is engagable in a selected hole of the location holes to set an angle of the front user bearer assembly relative to the support beam.

22. The exercise apparatus as claimed in claim 1, wherein the support beam is pivotally mounted to the guide block.

23. The exercise apparatus as claimed in claim 1, wherein the front user bearer assembly is height adjustable.

24. The exercise apparatus as claimed in claim 1, further comprising a counterweight to compensate for a weight of the front user bearer assembly.

* * * * *